US006270367B1

(12) United States Patent
Bussard

(10) Patent No.: US 6,270,367 B1
(45) Date of Patent: Aug. 7, 2001

(54) SELF TERMINATING COAXIAL COUPLER

(75) Inventor: W. Brook Bussard, Dallas, TX (US)

(73) Assignee: M&P Ventures, Inc., Dallas, TX (US)

( * ) Notice: Subject to any disclaimer, the term of this patent is extended or adjusted under 35 U.S.C. 154(b) by 0 days.

(21) Appl. No.: 09/419,411

(22) Filed: Oct. 15, 1999

(51) Int. Cl.[7] ..... H01R 29/00
(52) U.S. Cl. ..... 439/188; 333/132; 439/944
(58) Field of Search ..... 439/188, 944; 200/51.1; 333/132, 136, 260

(56) References Cited

U.S. PATENT DOCUMENTS 3,873,785 * 3/1975 Lieberman ..... 200/51.1
5,281,933 * 1/1994 Chamberlin ..... 333/132
5,598,132 * 1/1997 Stabile ..... 333/22 R
6,019,622 * 2/2000 Takahashi et al. ..... 439/188

* cited by examiner

*Primary Examiner*—Gary F. Paumen
*Assistant Examiner*—Phuongchi Nguyen
(74) *Attorney, Agent, or Firm*—Jackson Walker L.L.P.

(57) ABSTRACT

A self terminating coaxial cable connector comprising a conductive casing and an opening there through; the opening having a first end, an insulator inserted in the opening; a conductive spring connected to a terminal; an insulative plug in the first end, the insulative plug having a central opening for receiving the central conductor of a coaxial cable at the first end; a first plate conductively connected to the conductive spring; and a resistive element at the first end conductively connected the conductive casing and positioned such that the conductive spring holds the first plate in contact with the resistive element when the cable is not connected to the self terminating coaxial cable connector and the central conductor of cable separates the first plate and the resistive element when it is connected to the self terminating coaxial cable connector.

38 Claims, 2 Drawing Sheets

SELF TERMINATING COAXIAL COUPLER

BACKGROUND OF THE INVENTION

1. Technical Field

The present invention relates to the field of coupling systems for coaxial cabling. More specifically, the present invention relates to a coupler which provides an automatic termination impedance when a cable is not connected to the coupler.

2. Description of the Related Art

Coaxial cables are used in many applications where high frequency signals are transmitted. Coaxial cable is also ideal in applications with low noise tolerance. A coaxial cable consists of at least one central conductor surrounded by a shielding conductor or conductors. The central and shielding conductors are separated by an insulator.

One of the most widely used applications of coaxial cabling is for cable television transmission. Most cable television subscribers have several outlets at their home or business. Generally, a splitter is used to provide a link between the service connection point outside the home and the outlet. The connection between the splitter and the outlets is provided by coaxial cabling. However, many homes have more outlets than televisions, thus outlets will remain unconnected in normal use. This can create 'ghosting' problems.

Ghosting occurs when there is an impedance mismatch at some point in the coaxial cable system. High frequency signals will partially reflect at the impedance mismatch. A television receiver will then receive two versions of the desired signal: one directly and one slightly delayed from the reflection. This can create a faint image of the picture that is slightly shifted on the screen from the desired program. This ghost picture is distracting and undesirable to the viewer.

Prior cabling systems use an external terminator to help prevent ghosting. The terminator provides an impedance that matches that of the coaxial cable. This minimizes reflection of the signal. However, the user must attach the terminator to each unused outlet. External terminators can become lost or misplaced, and require manual installation or removal whenever a television is connected to or disconnected from the cabling system.

Self-terminating coaxial connectors are described in Hauver (U.S. Pat. No. 4,660,921) and Stabile (U.S. Pat. No. 5,598,132). These connectors include a resistor in a special cavity in the body of the connector. A spring loaded mechanism disconnects the resistor when a cable is plugged into the connector. However, these devices occupy a large, non-standard form factor. This requires retooling and redesign for the customer to adopt the connector. Also, prior connectors require difficult manufacturing techniques that add to the expense of the device. There is a need for a self-terminating connector that is inexpensive to manufacture and conforms to existing form factors.

BRIEF SUMMARY OF THE INVENTION

A described embodiment of the present invention includes a self terminating coaxial cable connector having: a conductive casing having an opening through the conductive casing, the opening having a first end; an insulating sleeve inserted in the opening; a conductive spring connected to a terminal; an insulative plug in the first end, the insulative plug having a central opening for receiving the central conductor of a coaxial cable at the first end; a first plate conductively connected to the conductive spring; and a resistive element at the first end conductively connected to the conductive casing and positioned such that the conductive spring holds the first plate in contact with the resistive element when the cable is not connected to the self terminating coaxial cable connector and the central conductor of cable separates the first plate and the resistive element when the is connected to the self terminating coaxial cable connector.

A second embodiment includes a self terminating coaxial cable connector having: a conductive casing having an opening through the conductive casing from a first end of the opening to a second end of the opening; an insulating sleeve inserted in the opening; a conductive sleeve for receiving the central conductor of a first coaxial cable at the first end; a conductive spring conductively connected to the conductive sleeve;

an insulative plug in the second end, the insulative plug having a central opening for receiving the central conductor of a second coaxial cable at the second end;

a first plate conductively connected to the conductive spring; and a resistive element at the second end conductively connected to the conductive casing and positioned such that the conductive spring holds the first plate in contact with the resistive element when the second cable is not connected to the self terminating coaxial cable connector and the central conductor of second cable separates the first plate and the resistive element when the second cable is connected to the self terminating coaxial cable connector.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION OF THE PREFERRED EMBODIMENT

Figure 1:
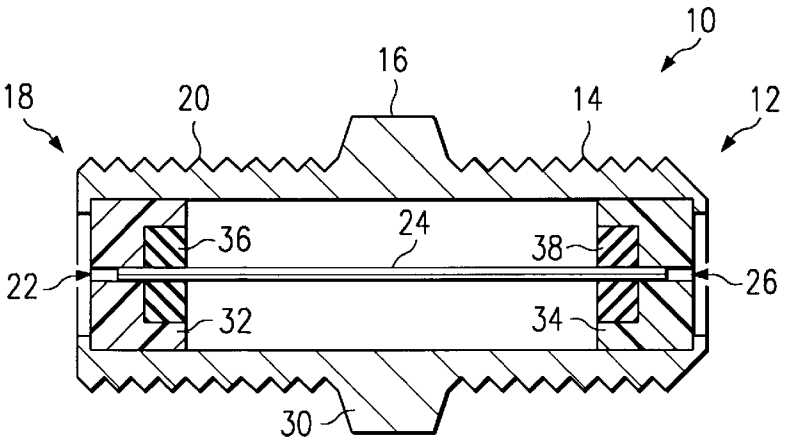
FIG. 1 (PRIOR ART)
FIG. 1 is a cut-away side view of a prior art coaxial coupler.

FIG. 1 is a cut-away view of a prior art coaxial coupler 10. Coupler 10 is designed to provide an outlet connection point at end 12. Usually, end 12 is inserted through an opening in a thin plate such as a switch plate (not shown). The switch plate abuts hexagonal stop 16 when coupler 10 is inserted. A nut (not shown) is then screwed onto threads 14 to hold the coupler in place. Behind the switch plate, a coaxial connection (not shown) is connected to end 18 by screwing the connector onto threads 20. The center conductor of the coaxial connection is inserted through opening to contact with pipe 24 or another conductive device. Pipe 24 is conductive and provides a conductive connection to the center conductor of a cable connected to end 12 through opening 26. Pipe 24 is held in place inside of barrel 30 by insulators 32 and 34 in conjunction with compression fittings 36 and 38, respectively.

To manufacture coupler 10, compression fittings 36 and 38 are injection molded into insulators 32 and 34, respectively. The combined assembly is pressed onto pipe 24 to make an internal assembly. The internal assembly is inserted into barrel 30 and barrel 30 is crimped at ends 12 and 18 to hold the internal assembly in place. This manufacturing process has proven to be reliable and inexpensive.

Figure 2:
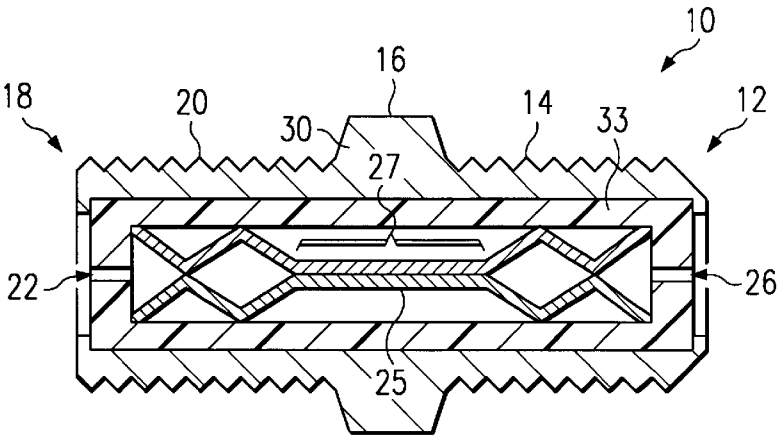
FIG. 2 (PRIOR ART)
FIG. 2 is a cut-away side view of another prior art coaxial coupler.

FIG. 2 is a cut-away view of another prior art coaxial coupler 11. Like numbered components to those in FIG. 1 perform identical functions to the like components in coaxial coupler 10 of FIG. 1. Coaxial coupler 10 includes hollow tubular insulator 33. Inserted into tubular insulator 33 is spring sleeve 25. The central conductor of a coaxial cable connected at end 18 makes conductive contact with spring sleeve 25. Spring sleeve 25 is fabricated from two pieces of suitably conductive spring metal that are bent so that the tips hold spring sleeve 25 in position. The two pieces of metal may be separate pieces that are soldered or welded together, or they may be one piece that is folded at central portion 27. Spring sleeve 25 is compressed and inserted into tubular insulator 33, and the assembly is inserted into barrel 30. The ends of barrel 30 are crimped to hold tubular insulator 33 in place as with coaxial coupler 10 of FIG. 1.

Figure 3:
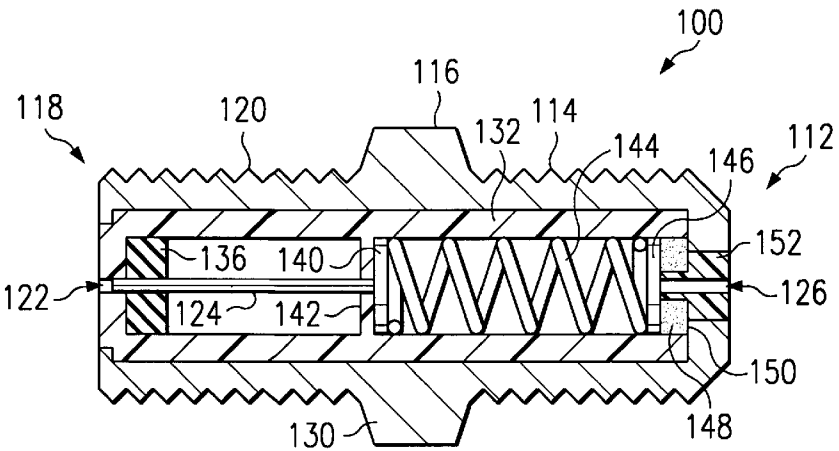
FIG. 3 is a cut-away side view of one embodiment of the present invention.

FIG. 3 is a cut-away side view of an embodiment of the present invention. Coupler 100 is designed to be used in applications where the couplers 10 and 11 of FIGS. 1 and 2 would be used. However, coupler 100 provides an automatic termination feature which minimizes energy reflection when no coaxial cable is connected to end 112 of coupler 100 while maintaining the form factor of coupler 10.

Coupler 100 is usually mounted using a nut (not shown) to compress the mounting surface between the nut and hexagonal stop 116. Conductive casing 130 is conductive and is preferably fabricated from aluminum using know metal fabrication techniques, although any known conductive material may be used. Compression fitting 136 is formed in insulator 132. Insulator 132 is preferably formed of injection-molded nylon plastic. However, many insulative materials are known in the art that can be molded and provide sufficient structural strength. Compression fitting 136 and insulator 132 hold pipe 124 in place. Compression fitting 136 is preferably formed of rubber, although any insulative material with suitable frictional properties may be used. Pipe 124 is conductively mounted to plate 140. Pipe 124 is preferably formed of gold plated steel, but may be any suitably conductive material. Supports 142 are formed in insulator 132 to provide backing and support to plate 140. Spring 144 is conductive and in contact with plate 140. At end 112, another plate 146 is installed. Plate 146 is conductive and is preferably attached to spring 144 using a conductive attachment technique such as soldering or welding.

Resistive element 148 is a washer shaped portion of resistive material. A preferred resistive material is carbon, but other materials that provide the needed resistance may be used. Resistive element 148 is in conductive contact with conductive casing 130 at point 150. The resistance of resistive element 148 between plate 146, when it is in contact with resistive element 148, and barrel 130 is selected to be approximately 75Ω for use with standard coaxial cable. In other systems the resistance will be adjusted to provide a match for the high frequency impedance of the coaxial cable being used.

Insulator 152 prevents the center conductor of a cable connected to end 112 from contacting resistive element 148. When a center conductor is inserted into opening 126, it is in conductive communication with pipe 124 via plate 146, spring 144 and plate 140. A completed connection is made when a coaxial cable is connected to end 118 and the center conductor is extended through opening 122 to contact pipe 124.

Figure 4:
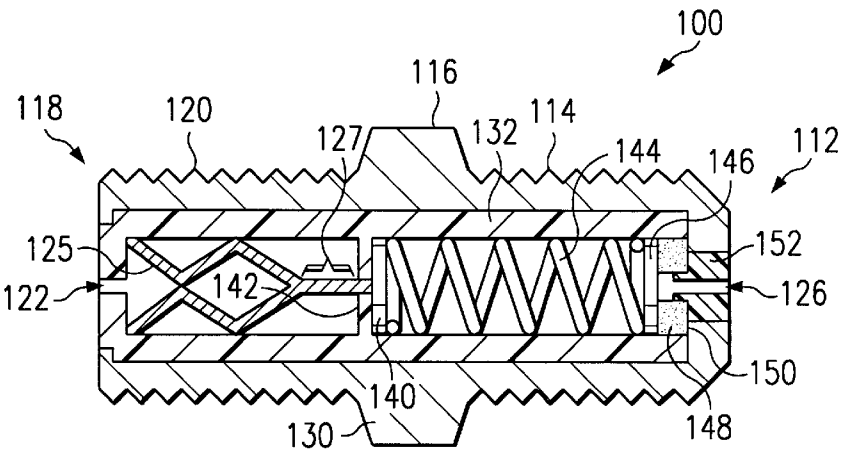
FIG. 4 is a cut-away side view of another embodiment of the present invention.

FIG. 4 is a cut-away view of another embodiment of the present invention. Like numbered components to those in FIG. 3 perform identical functions to the like components in coaxial coupler 100 of FIG. 1. Coaxial coupler 101 includes a spring sleeve 125 that is conductively bonded to plate 140. The central conductor of a coaxial cable connected at end 118 makes conductive contact with spring sleeve 125. Spring sleeve 125 is fabricated from two pieces of suitably conductive spring metal that are bent so that the tips hold spring sleeve 125 in position. Examples of suitable materials are alloys of copper, aluminum and steel. The two pieces of metal may be separate pieces that are soldered or welded together, or they may be one piece that is folded at portion 127. Spring sleeve 125 is compressed and inserted into tubular insulator 132, and the assembly is inserted into conductive casing 130. The ends of barrel 130 are crimped to hold tubular insulator 132 in place as with coaxial coupler 100 of FIG. 3. Spring sleeve 125 is a substitute for pipe 124 of FIG. 3.

Figure 5:
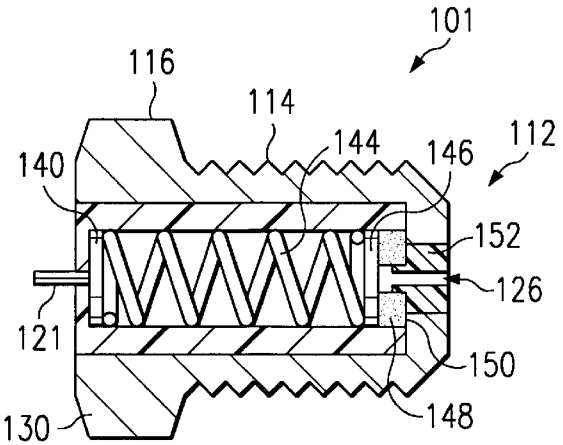
FIG. 5 is a cut-away side view of yet another embodiment of the present invention.

FIG. 5 is another embodiment of the present invention. Coupler 101 is designed for installation in the panels of communications equipment such as cable decoder boxes, splitters, combiners, computer network routers and video cassette recorders. Like numbered components in FIG. 3 perform the same function in coupler 101 as they perform in coupler 100 of FIG. 3. Rather than connecting a cable to end 118 as in the embodiment of FIG. 3, conductive casing 130 is placed in contact with the chassis of the equipment. Terminal 121 is connected to plate 140. Terminal 121 is then used as a connection point to transmit the received signal into the circuitry of the equipment. Usually, this is provided by soldering a short piece of wire between the circuit board of the equipment and terminal 121.

Figure 6:
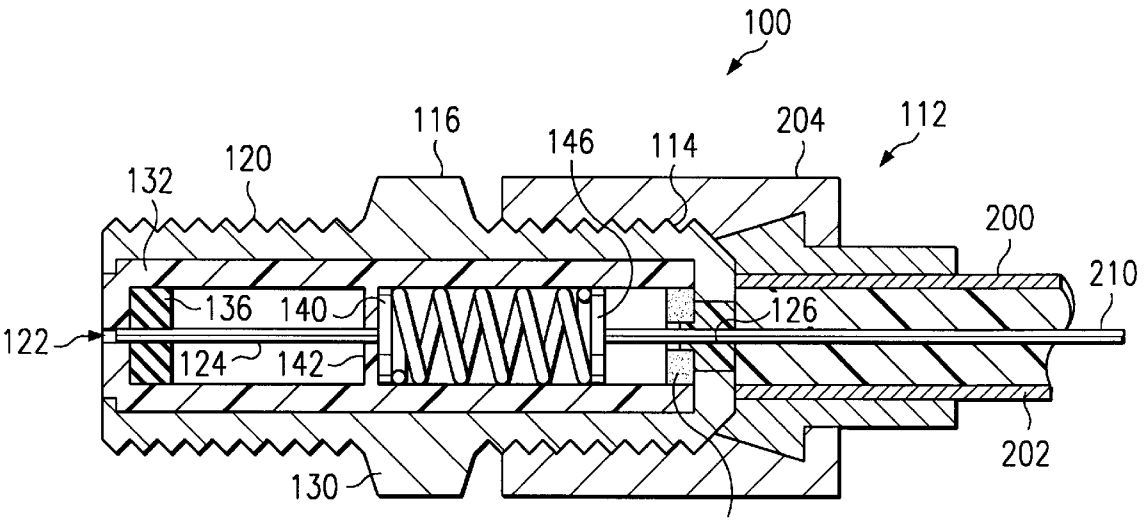
FIG. 6 is a cut-away side view of the embodiment of FIG. 3 with a coaxial connected.

FIG. 6 is a cut-away side view of coupler 100 of FIG. 3 with a coaxial cable 200 connected to end 112. As is standard for coaxial cable connections. The shielding conductor 202 is connected a coupler 208, which consists of fixed portion and threaded collar 204. Threaded collar 204 is screwed onto threads 114 to provide mechanical connection. Center conductor 210 is trimmed to extend through central opening 126 to contact plate 146. As can be seen from FIG. 6, center conductor 210 separates plate 146 from resistive element 148. This disconnects the terminating resistance because it is no longer necessary. Cable 200 provides the necessary impedance to minimize signal reflection at end 112. Thus the terminating impedance provided by resistive element 148 is automatically disconnected when a cable is attached to end 112.

Figure 7:
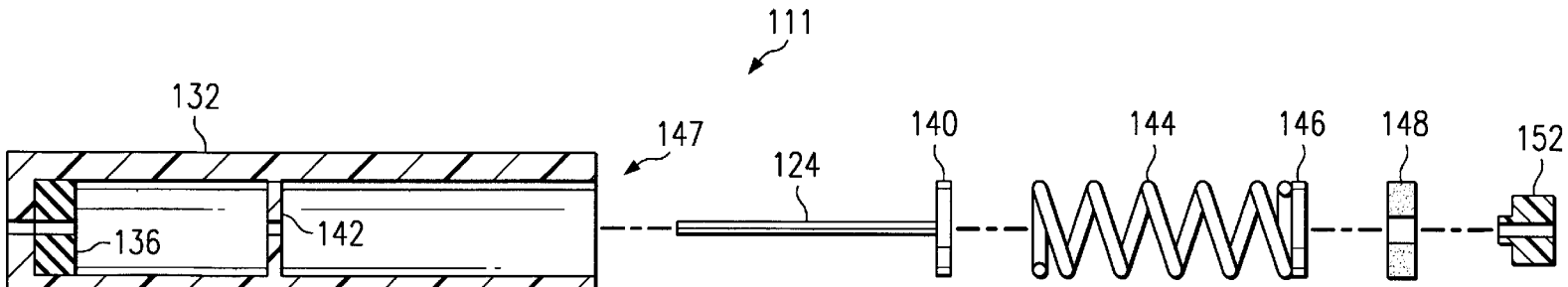
FIG. 7 is an exploded view of the core of the embodiment of FIG. 2.

Of importance, conductive casing 130 provides the same form factor as the prior coupler 10 shown in FIG. 1, but provides the additional feature of including an automatic termination. In addition, the embodiments of FIGS. 3–6 are cheaper and easier to manufacture than prior self terminating couplers. FIG. 7 shows an exploded view of the core 111 of coupler 100 of FIG. 3. Core 111 is formed by inserting pipe 124, which is mounted to plate 140, through the opening in supports 142 and pressing pipe 124 into compression fitting 136. Next, spring 144, which is mounted to plate 146, is inserted. Resistive element 148 and insulator 152 are then pressed into opening 147 of insulator 132. Assembled core 111 is then inserted into barrel 130 (FIG. 3) and both ends 112 and 118 of barrel 130 are crimped to hold core 111 in place.

Although specific embodiments are described herein, they are not to be construed as defining the scope of the present invention. For example, although the described embodiments use a threaded coupling, the invention may be advantageously used with other coupling techniques push and twist system shown in Stein et al. (U.S. Pat. No. 5,219,297). The present invention is limited only by the claims appended hereto.

What is claimed is:

1. A self terminating coaxial cable connector comprising:

a conductive casing having an opening through the conductive casing, the opening having a first end;

an insulator inserted in the opening;

a conductive spring connected to a terminal;

an insulative plug in the first end, the insulative plug having a central opening for receiving the central conductor of a coaxial cable at the first end;

a first plate conductively connected to the conductive spring; and a resistive element at the first end conductively connected to the conductive casing and positioned such the conductive spring holds the first plate in contact with the resistive element when the cable is not connected to the self terminating coaxial cable connector and the central conductor of the cable separates the first plate and the resistive element when the cable is connected to the self terminating coaxial cable connector.

2. A self terminating coaxial cable connector as in claim 1 wherein the terminal is in conductive contact with a second conductive plate, the major plane of the second conductive plate being substantially perpendicular to the major axis of the opening in the conductive sleeve and the conductive spring is in conductive contact with the second conductive plate.

3. A self terminating coaxial cable connector as in claim 1 wherein the conductive casing is threaded.

4. A self terminating coaxial cable connector as in claim 1 wherein the conductive casing is aluminum.

5. A self terminating coaxial cable connector as in claim 1 wherein the resistive element is carbon.

6. A self terminating coaxial cable connector as in claim 1 wherein the insulator is plastic.

7. A self terminating coaxial cable connector as in claim 1 wherein the conductive casing is crimped at either end.

8. A self terminating coaxial cable connector as in claim 1 wherein the impedance of the resistive element is selected to match the impedance of the cable.

9. A self terminating coaxial cable connector comprising:

a conductive casing having an opening through the conductive casing from a first end of the opening to a second end of the opening;

an insulator sleeve inserted in the opening;

a conductive sleeve for receiving the central conductor of a first coaxial cable at the first end;

a conductive spring conductively connected to the conductive sleeve;

an insulative plug in the second end, the insulative plug having a central opening for receiving the central conductor of a second coaxial cable at the second end;

a first plate conductively connected to the conductive spring; and a resistive element at the second end conductively connected to the conductive casing and positioned such the conductive spring holds the first plate in contact with the resistive element when the second cable is not connected to the self terminating coaxial cable connector and the central conductor of second cable separates the first plate and the resistive element when the second cable is connected to the self terminating coaxial cable connector.

10. A self terminating coaxial cable connector as in claim 9 wherein the conductive sleeve is a pipe.

11. A self terminating coaxial cable connector as in claim 9 wherein the conductive sleeve is a spring sleeve.

12. A self terminating coaxial cable connector as in claim 9 wherein the conductive casing is threaded.

13. A self terminating coaxial cable connector as in claim 9 wherein the conductive sleeve extends to and is in conductive contact with a second conductive plate, the major plane of the second conductive plate being substantially perpendicular to the major axis of the opening in the conductive sleeve and the conductive spring is in conductive contact with the second conductive plate.

14. A self terminating coaxial cable connector as in claim 9 where the insulator includes a compression fitting for firmly holding the conductive sleeve.

15. A self terminating coaxial cable connector as in claim 9 wherein the conductive casing is aluminum.

16. A self terminating coaxial cable connector as in claim 9 wherein the resistive element is carbon.

17. A self terminating coaxial cable connector as in claim 9 wherein the insulator sleeve is plastic.

18. A self terminating coaxial cable connector as in claim 9 wherein the conductive casing is crimped at either end.

19. A self terminating coaxial cable connector as in claim 9 wherein the impedance of the resistive element is selected to match the impedance of the second cable.

20. A method for forming self terminating coaxial cable connector comprising:

providing a conductive casing having an opening through the conductive casing, the opening having a first end;

inserting an insulating sleeve in the opening;

providing a conductive spring inside the insulating sleeve connected to a terminal;

providing an insulative plug in the first end, the insulative plug having a central opening for receiving the central conductor of a coaxial cable at the first end;

providing a first plate conductively connected to the conductive spring; and providing a resistive element at the first end conductively connected to the conductive casing and positioned such the conductive spring holds the first plate in contact with the resistive element when the cable is not connected to the self terminating coaxial cable connector and the central conductor of the cable separates the first plate and the resistive element when the cable is connected to the self terminating coaxial cable connector.

21. A method for forming a self terminating coaxial cable connector as in claim 20 further comprising the steps of crimping both ends of the conductive casing to hold the insulating sleeve in place.

22. A method for forming a self terminating coaxial cable connector as in claim 20 wherein the terminal is in conductive contact with a second conductive plate, the major plane of the second conductive plate being substantially perpendicular to the major axis of the opening in the conductive sleeve and the conductive spring is in conductive contact with the second conductive plate.

23. A method for forming a self terminating coaxial cable connector as in claim 20 wherein the conductive casing is aluminum.

24. A method for forming a self terminating coaxial cable connector as in claim 20 wherein the resistive element is carbon.

25. A method for forming a self terminating coaxial cable connector as in claim 20 wherein the insulative sleeve is plastic.

26. A method for forming a self terminating coaxial cable connector as in claim 20 wherein the conductive casing is threaded.

27. A method for forming a self terminating coaxial cable connector as in claim 20 wherein the impedance of the resistive element is selected to match the impedance of the cable.

28. A method for forming a self terminating coaxial cable connector comprising:

providing a conductive casing having an opening through the conductive casing from a first end of the opening to a second end of the opening;

inserting an insulating sleeve into the opening;

inserting a conductive sleeve into the insulating sleeve for receiving the central conductor of a first coaxial cable at the first end;

providing a conductive spring conductively connected to the conductive sleeve;

inserting an insulative plug in the second end, the insulative plug having a central opening for receiving the central conductor of a second coaxial cable at the second end;

providing a first plate conductively connected to the conductive spring; and providing a resistive element at the second end conductively connected to the conductive casing and positioned such that the conductive spring holds the first plate in contact with the resistive element when the second cable is not connected to the self terminating coaxial cable connector and the central conductor of second cable separates the first plate and the resistive element when the second cable is connected to the self terminating coaxial cable connector.

29. A method for forming a self terminating coaxial cable connector as in claim 28 wherein the conductive sleeve is a pipe.

30. A method for forming a self terminating coaxial cable connector as in claim 28 wherein the conductive sleeve is a spring sleeve.

31. A method for forming a self terminating coaxial cable connector as in claim 28 wherein the conductive casing is threaded.

32. A method for forming a self terminating coaxial cable connector as in claim 28 wherein the conductive sleeve extends to and is in conductive contact with a second conductive plate, the major plane of the second conductive plate being substantially perpendicular to the major axis of the opening in the conductive sleeve and the conductive spring is in conductive contact with the second conductive plate.

33. A method for forming a self terminating coaxial cable connector as in claim 28 where the insulative sleeve includes a compression fitting for firmly holding the conductive sleeve.

34. A method for forming a self terminating coaxial cable connector as in claim 28 wherein the conductive casing is aluminum.

35. A method for forming a self terminating coaxial cable connector as in claim 28 wherein the resistive element is carbon.

36. A method for forming a self terminating coaxial cable connector as in claim 28 wherein the insulative sleeve is plastic.

37. A method for forming a self terminating coaxial cable connector as in claim 28 further comprising the step of crimping the conductive casing at either end.

38. A method for forming a self terminating coaxial cable connector as in claim 28 wherein the impedance of the resistive element is selected to match the impedance of the second cable.

* * * * *